US009661733B1

(12) United States Patent
Elizondo-Decanini

(10) Patent No.: US 9,661,733 B1
(45) Date of Patent: May 23, 2017

(54) SWITCH DEVICE HAVING A NON-LINEAR TRANSMISSION LINE

(71) Applicant: Sandia Corporation, Albuquerque, NM (US)

(72) Inventor: Juan M. Elizondo-Decanini, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 15/281,991

(22) Filed: Sep. 30, 2016

(51) Int. Cl.
*H05B 31/26* (2006.01)
*H05H 1/48* (2006.01)

(52) U.S. Cl.
CPC ..... *H05H 1/48* (2013.01)

(58) Field of Classification Search
CPC .. H01P 1/182; H01P 5/02; H05H 5/03; H05H 5/06
USPC ..... 315/111.31
See application file for complete search history.

(56) References Cited

U.S. PATENT DOCUMENTS 5,352,994 A * 10/1994 Black ..... H03H 7/325 257/E27.012
6,300,720 B1 * 10/2001 Birx ..... F03H 1/0087 315/111.21
8,922,973 B1 12/2014 Elizondo-Decanini

* cited by examiner

*Primary Examiner* — Daniel D Chang
(74) *Attorney, Agent, or Firm* — Sterne Kessler Goldstein Fox; John McGroarty

(57) ABSTRACT

Switching devices are provided. The switching devices include an input electrode, having a main electrode and a trigger electrode, and an output electrode. The main electrode and the trigger electrode are separated from the output electrode by a main gap and a trigger gap, respectively. During operation, the trigger electrode compresses and amplifies a trigger voltage signal causing the trigger electrode to emit a pulse of energy. This pulse of energy form plasma near the trigger electrode, either by arcing across the trigger gap, or by arcing from the trigger electrode to the main electrode. This plasma decreases the breakdown voltage of the main gap. Simultaneously, or near simultaneously, a main voltage signal propagates through the main electrode. The main voltage signal emits a main pulse of energy that arcs across the main gap while the plasma formed by the trigger pulse is still present.

20 Claims, 8 Drawing Sheets

SWITCH DEVICE HAVING A NON-LINEAR TRANSMISSION LINE

STATEMENT OF GOVERNMENTAL INTEREST

This invention was developed under Contract DE-AC04-94AL85000 between Sandia Corporation and the U.S. Department of Energy. The U.S. Government has certain rights in this invention.

BACKGROUND

A detonator is a device used to trigger an explosive device. Detonators can be chemically, mechanically, or electrically initiated. There are three categories of electrical detonators: instantaneous electrical detonators (IED), short period delay detonators (SPD) and long period delay detonators (LPD). Delays in SPDs are measured in milliseconds, and delays in LPDs are measured in seconds. These conventional electrical detonators often use switches that activate using a surface breakdown. For example, some conventional switches use a thin/thick dielectric film between two electrodes that needs to be broken down by a high voltage. However, these conventional switches often suffer from switch to switch jitter behavior. In some situations, two switches operating at similar voltage amplitudes and with similar voltage pulse rise times, can often have their dielectric gap breakdown occur with different timing. For example, one switch can operate 100 ns after initial voltage application but a second switch can operate after 250 ns after the initial voltage application. This switch jitter behavior often results from variations of thickness of dielectric material of the dielectric gap which can result in variations of the time required for the voltage application to break through the dielectric gap.

SUMMARY

Switching devices are provided. The switching devices include an input electrode, having a main electrode and a trigger electrode, and an output electrode. The main electrode and the trigger electrode are separated from the output electrode by a main gap and a trigger gap, respectively. During operation, the trigger electrode compresses and amplifies a trigger voltage signal causing the trigger electrode to emit a pulse of energy. This pulse of energy form plasma near the trigger electrode, either by arcing across the trigger gap, or by arcing from the trigger electrode to the main electrode. This plasma decreases the breakdown voltage of the main gap. Simultaneously, or near simultaneously, a main voltage signal propagates through the main electrode. The main voltage signal emits a main pulse of energy that arcs across the main gap while the plasma formed by the trigger pulse is still present. Thereafter, current flows from the main electrode, through the arc, to the output electrode to provide an output voltage signal.

A first exemplary switch device includes an input electrode and an output electrode. The input electrode includes a central electrode, a main electrode electrically connected to the central electrode, and a trigger electrode electrically connected to the central electrode, The trigger electrode includes a non-linear transmission line. In this first exemplary switch device, a first part of the output electrode is separated from an end of the main electrode by a main gap and a second part of the output electrode is separated from an end of the trigger electrode by a trigger gap. The trigger gap and main gap are located such that arcing of a current across the trigger gap or between the main electrode and the trigger electrode decreases a breakdown voltage of the main gap.

A second exemplary switch device includes an input electrode and an output electrode. The input electrode includes a main electrode and a trigger electrode having, a non-linear transmission line. The output electrode is separated from the main electrode and the trigger electrode by a main gap and a trigger gap, respectively. In this second exemplary switch device, the non-linear transmission line compresses and amplifies a trigger voltage signal to cause the trigger electrode to emit a trigger pulse of energy. The trigger pulse of energy creates plasma in or near the main gap, such that a breakdown voltage of the main gap decreases. The main electrode propagates a main voltage signal to cause the main electrode to emit a main pulse of energy. The main pulse of energy creates, assisted by the plasma created by the trigger pulse of energy, an arc from the main gap to the output electrode.

A method for operating a switch device is also disclosed. The switch device includes an input electrode, including a main electrode and a trigger electrode, and an output electrode, the output electrode being separated from the main electrode and the trigger electrode by a main gap and a trigger gap, respectively. The method includes transmitting an input voltage signal to the input electrode, wherein the input voltage signal creates a trigger voltage signal in the trigger electrode, and a main voltage signal in the main electrode, compressing and amplifying the trigger voltage signal in the trigger electrode, to create a trigger pulse of energy that creates plasma in or near the main gap, such that a breakdown voltage of the main gap decreases, and propagating the main voltage signal along the main electrode to the main gap, to create a main pulse of energy that arcs across the main gap to the output electrode while the breakdown voltage of the main gap is decreased.

BRIEF DESCRIPTION OF THE DRAWINGS/FIGURES

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion. In the drawings.

Figure 1A:
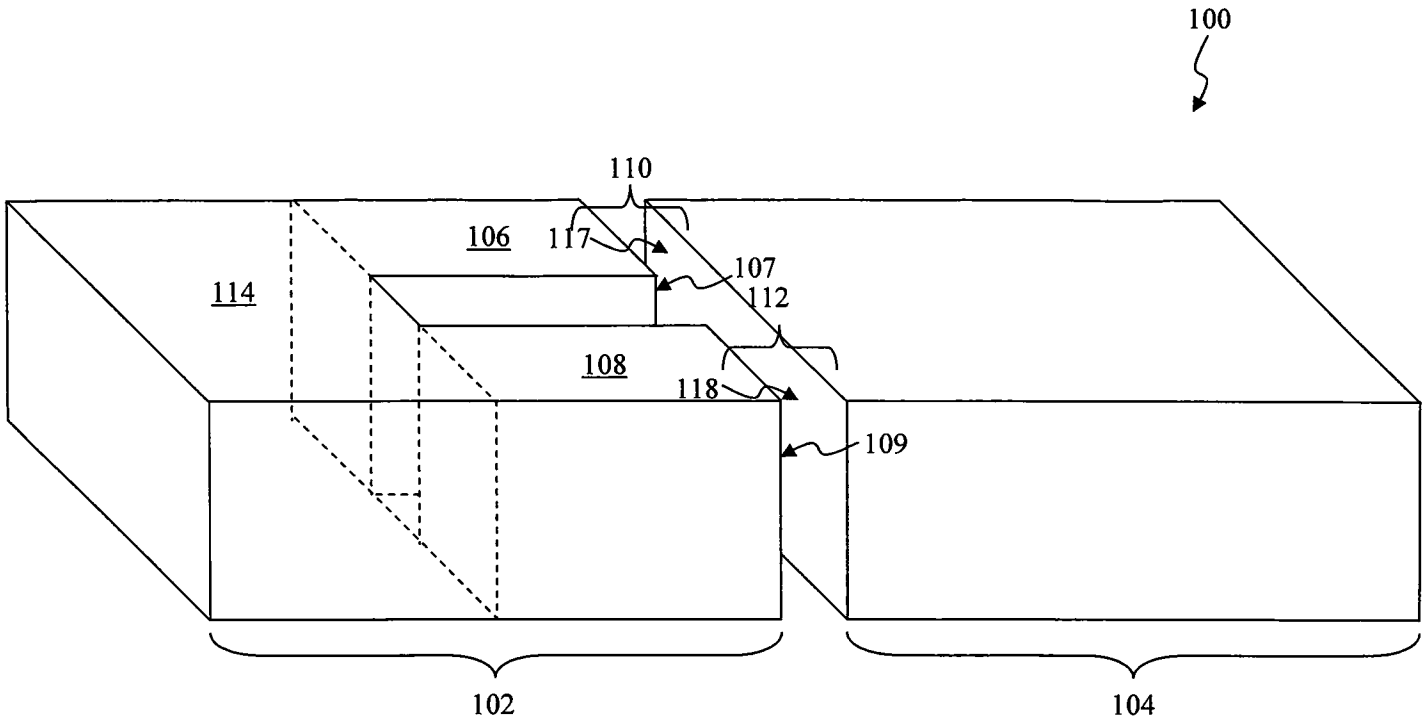
FIG. 1A shows an embodiment of a switch device.

The disclosure will now be described with reference to the accompanying drawings. In the drawings, like reference numbers generally indicate identical, functionally similar, and/or structurally similar elements. The drawing in which an element first appears is indicated by the leftmost digit(s) in the reference number.

OVERVIEW

In some embodiments, switching devices are provided. The switching devices include an input electrode, having a main electrode and a trigger electrode, and an output electrode. The main electrode and the trigger electrode are separated from the output electrode by a main gap and a trigger gap, respectively. During operation, the trigger electrode compresses and amplifies a trigger voltage signal causing the trigger electrode to emit a pulse of energy. This pulse of energy form plasma near the trigger electrode, either by arcing across the trigger gap, or by arcing from the trigger electrode to the main electrode. This plasma decreases the breakdown voltage of the main gap. Simultaneously, or near simultaneously, a main voltage signal propagates through the main electrode. The main voltage signal emits a main pulse of energy that arcs across the main gap while the plasma formed by the trigger pulse is still present. Thereafter, current flows from the main electrode, through the arc, to the output electrode to provide an output voltage signal. Because the trigger electrode amplifies and compresses the trigger voltage signal, the trigger pulse can reliably form a plasma based on an input voltage signal lower than would be possible in the absence of amplification. And, the plasma formed by the trigger pulse allows the main pulse to arc based on an input voltage lower than would be possible in the absence of such plasma.

First Exemplary Switch Device

FIG. 1A shows an embodiment of a switch device. A switch device 100 includes an input electrode 102 and an output electrode 104. Input electrode 102 includes a main electrode 106 having an end 107, and a trigger electrode 108 having an end 109. Output electrode 104 includes a first part 117 and a second part 118. Main electrode 106 and trigger electrode 108 are electrically connected by a central electrode 114. A main gap 110 separates end 107 of main electrode 106 from first part 117 of output electrode 104. A trigger gap 112 separates end 109 of trigger electrode 108 from output second part 118 of electrode 104. Because of the way main electrode 106, trigger electrode 108 and output electrode 104 are situated, first part 117 and second part 118 are different, separate and distinct parts of output electrode 104.

In some embodiments, the main gap 110 has a length of 2 microns to 1000 microns. In some embodiments, the length of the main gap 110 is not more than ten percent different than the length of the trigger gap 112. In most embodiments the ratio of the main gap 110 to trigger gap 112 is determined by the amplification factor designed with the nonlinear transmission line amplifier; and if the main gaps are in air/gas or embedded in a substrate.

Trigger electrode 108 includes a non-linear transmission line configured to compress and amplify a voltage pulse as it travels along the non-linear transmission line. Any suitable structure may be used for the non-linear transmission line. Non-linear transmission lines are described in further detail below, including the description of FIG. 5.

While input electrode 102 and output electrode 104, and other electrodes described herein are illustrated as having the shape of several rectangular prisms for ease of illustration, any suitable electrode shape may be used.

The length of main gap 110 is the shortest distance that separates main electrode 106 from output electrode 104. Similarly, the length of trigger gap 112 is the shortest distance that separates trigger electrode 108 from output electrode 104. End 107 and first part 117 are located at the ends of main gap 110. End 109 and second part 118 are located at the ends of trigger gap 112. As illustrated in FIG. 1, an end 107 of the main electrode 106 represents a surface, edge, or point of the main electrode 106 that is closest to the output electrode 104. As such, end 107 is in physical contact with main gap 110. Similarly, an end 109 of trigger electrode 108 represents a surface, edge, or point of trigger electrode 108 that is closest to output electrode 104. As such, end 109 is in physical contact with trigger gap 112. In some embodiments, the length of main gap 110 is about the same as the length of trigger gap 112. In some embodiments, the length of main gap 110 is not more than ten percent different from the length of trigger gap 112.

Figure 1B:
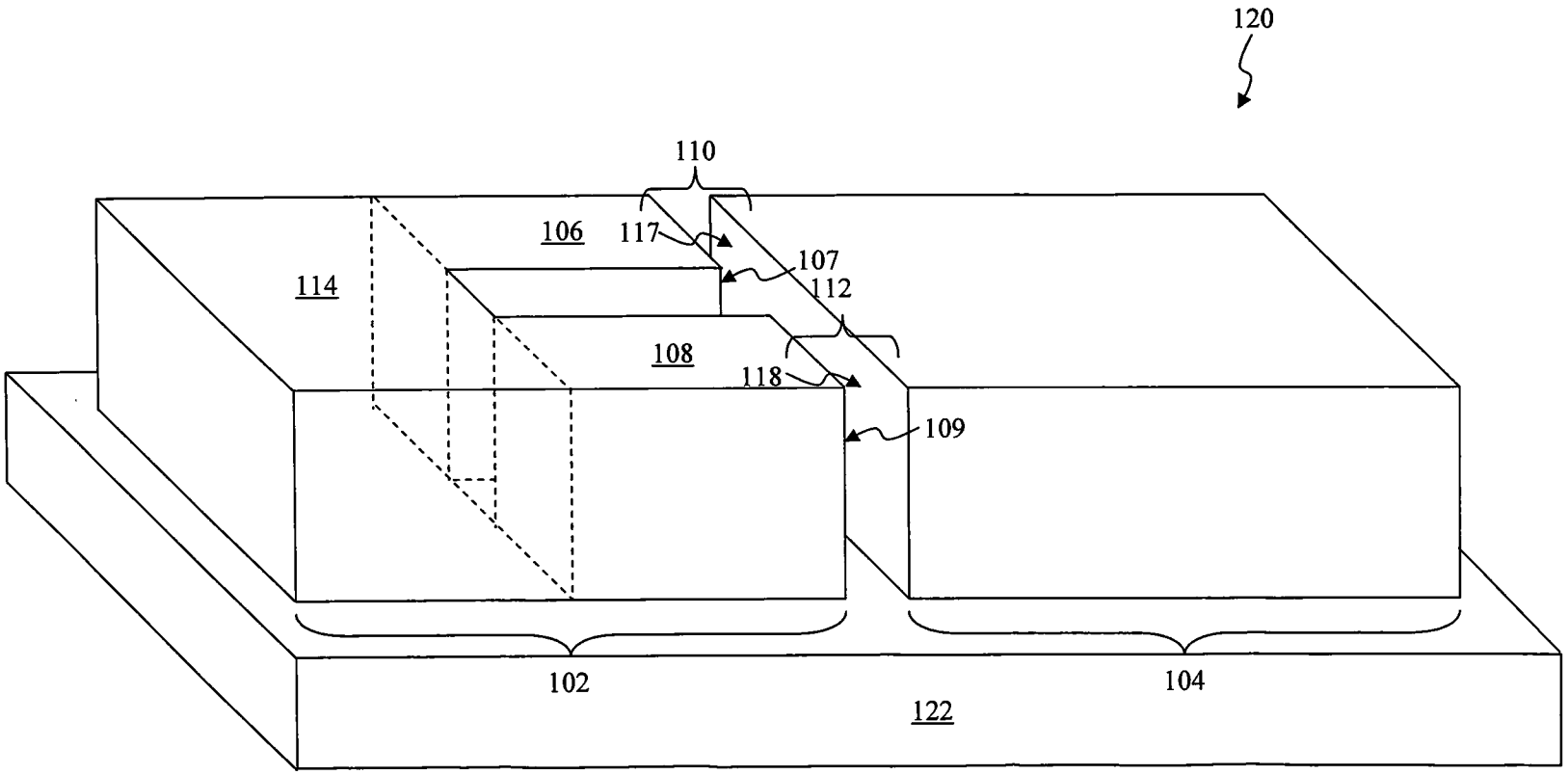
FIG. 1B shows the switch device of FIG. 1A disposed on a surface.
Figure 1C:
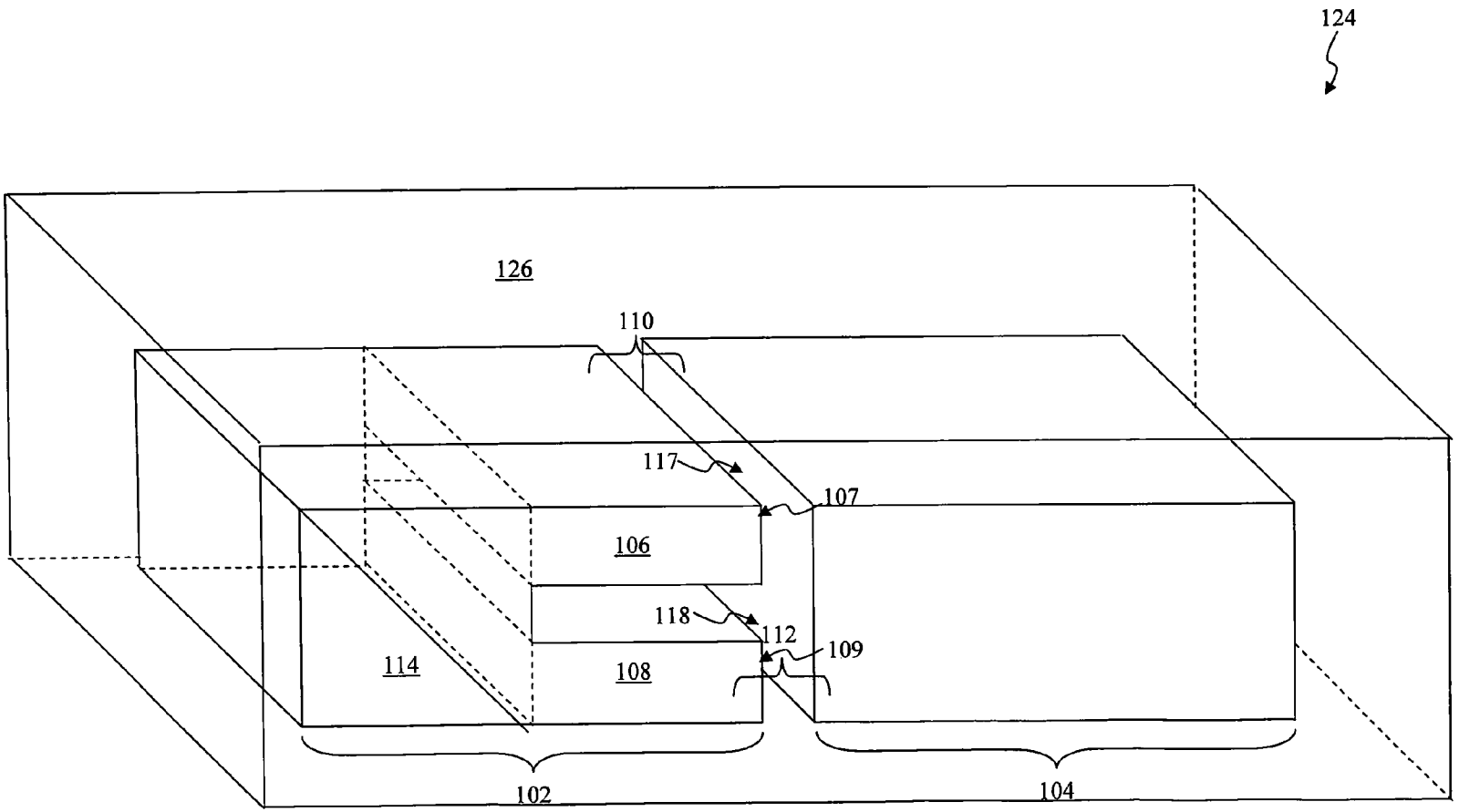
FIG. 1C shows the switch device of FIG. 1A embedded in a substrate.

In the embodiment of FIGS. 1A-1C, main electrode 106 extends from main gap 110 in a first direction. Trigger electrode 108 extends away from trigger gap 112 in first direction, i.e., in the same first direction parallel to main electrode 106. Main electrode 106 extends away from main gap 110 in a direction parallel to that of main gap 110. And, trigger electrode 108 extends away from trigger gap 112 in a direction parallel to that of trigger gap 112. Trigger electrode 108 is not disposed in the main gap.

In some embodiments, a gas or a non-conductive solid may be disposed in main gap 110 and/or trigger gap 112. Suitable non-conductive solids and gasses are described in more detail below.

FIG. 1B shows the switch device of FIG. 1A disposed on a substrate. A switch device 120 is substantially similar to switch device 100 as described above in FIG. 1A. As such, the switch device 120 includes input electrode 102, main electrode 106, trigger electrode 108, central electrode 114, output electrode 104, main gap 110, trigger gap 112, end 107, end 109, first part 117 and second part 118. As illustrated in FIG. 1B, switch device 120 is disposed on a surface of a substrate 122. In some embodiments, switch device 120 may be fabricated or disposed on substrate 122 using any suitable technique.

Substrate 122 can be any suitable material. In one embodiment, substrate 122 is a ceramic such as $Al_2O_3$, a polymer based dielectric material or silicon dioxide. Substrate 122 may be or include other materials, or combinations of materials, such as sapphire or any other suitable material.

Because switch device 120 is disposed on the surface of substrate 122, main gap 110 and trigger gap 112 are filled with gas as illustrated in FIG. 1B. Suitable gasses include noble gasses, oxygen ($O_2$), carbon dioxide ($CO_2$), air, nitrogen, and mixtures thereof. Any other suitable gas may be used. In some embodiments, the switch device 100 can be situated within a package or housing that is filled with gas, such that main gap 110 and trigger gap 112 are filled with the gas.

FIG. 1C shows the switch device of FIG. 1A embedded in a substrate. A switch device 124 is substantially similar to switch device 100 as described above in FIG. 1A. As such, the switch device 124 includes input electrode 102, main electrode 106, trigger electrode 108, central electrode 114, output electrode 104, main gap 110, trigger gap 112, end 107, end 109, first part 117 and second part 118. Switch device 124 is embedded in a substrate 126. Relative to switch device 120 of FIG. 1B, switch device 120 has been rotated 90 degrees and is embedded in substrate 126 instead of being disposed on a surface. In some embodiments, switch device 120 may be fabricated using any suitable technique.

Switch device 120 is embedded in substrate 126. In some embodiments, as illustrated in FIG. 1C, main gap 110 and trigger gap 112 are through the substrate 126 filled with a solid material of substrate 126. Substrate 126 may be any suitable non-conducting material, such as silicon dioxide ($SiO_2$), biaxially-oriented polyethylene terephthalate (such as sold under the trade name Mylar®), polyimide (such as sold under the trade name Kapton®), polystyrene, polyurethane, or parylene to provide some examples.

In some embodiments, the one or more solid materials 126 disposed in main gap 110 and trigger gap 112 can be removed and filled with a gas. The gas can include individual atoms, for example, a noble gas, having molecules made from one type of atom, for example, oxygen ($O_2$), having compound molecules made from a variety of atoms, for example carbon dioxide ($CO_2$), or having a mixture of individual atoms and/or molecules to provide some examples.

While switch device 120 is illustrated as entirely embedded in substrate 126, other configurations may be used where switch device 120 is only partially embedded. For example, the surfaces of main electrode 106 and output electrode 104 closest to the surface of substrate 126 may be exposed. A partially exposed structure may be easier to fabricate than a completely embedded structure. So long as main gap 110 and trigger gap 112 are entirely through the substrate, and there is no alternate path between the relevant electrodes having a lower resistance than main gap 110 and trigger gap 112, switch device 120 will still function in the same manner as an embedded switch.

Second Exemplary Switch Device

Figure 2:
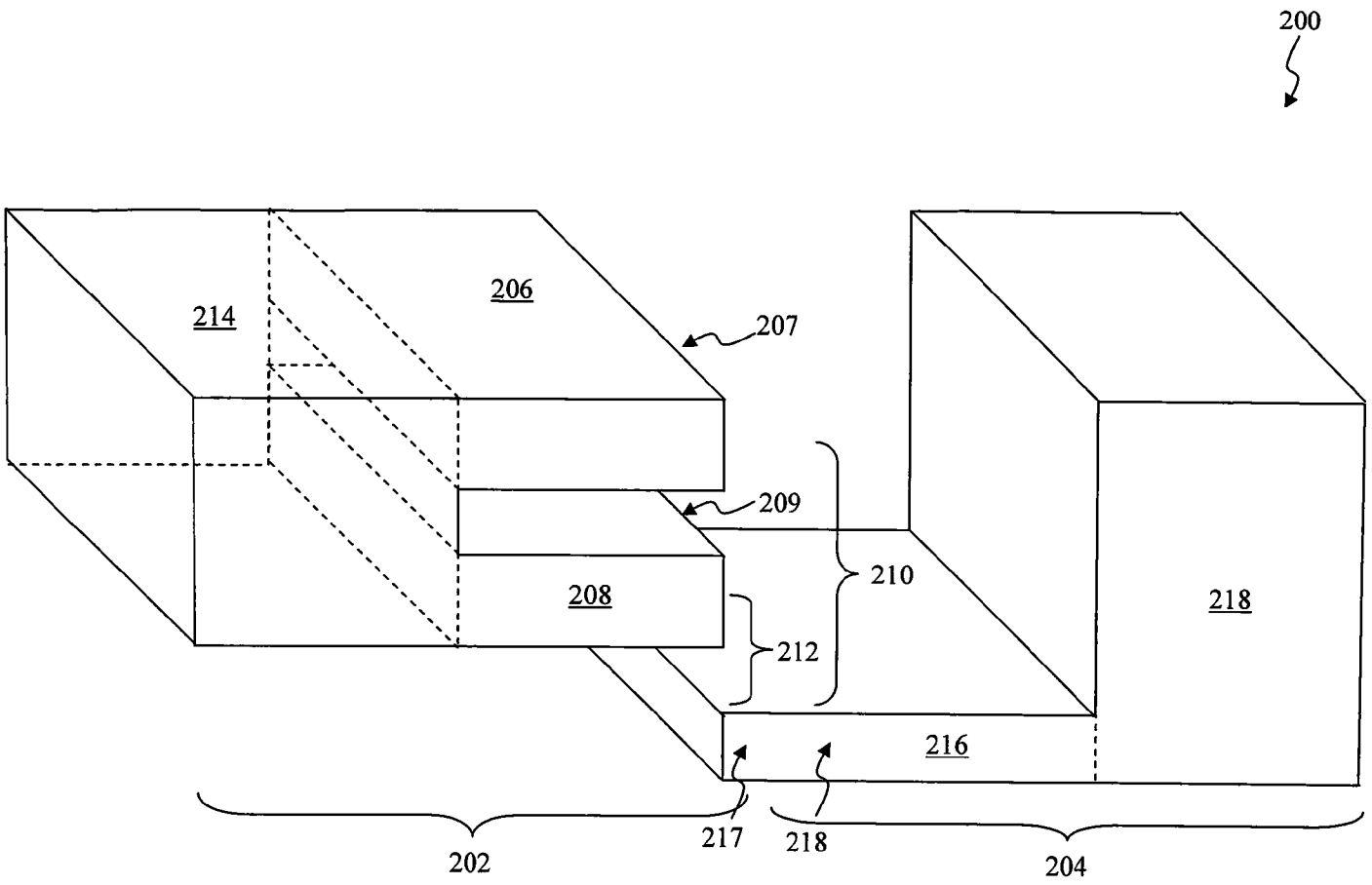
FIG. 2 shows an embodiment of a switch device having an electrode configuration different from that of FIG. 1A.

FIG. 2 shows an embodiment of a switch device. A switch device 200 includes an input electrode 202 and an output electrode 204. Input electrode 202 includes a main electrode 206 having an end 207, and a trigger electrode 208 having an end 209. Output electrode 204 includes a first part 217. Main electrode 206 and trigger electrode 208 are electrically connected by a central electrode 214. A main gap 210 separates end 207 of main electrode 206 from first part 217 of output electrode 204. A trigger gap 212 separates end 209 of trigger electrode 208 from first part 217 output electrode 204. First part 217 is the part of output electrode 204 that is closest to both main electrode 206 and trigger electrode 208.

Output electrode 204, main electrode 206 and trigger electrode 208 of switch device 200 are oriented differently than the corresponding parts of switch device 100. In the embodiment of FIG. 2, main electrode 206 extends from main gap 210 in a first direction. Trigger electrode 208 extends away from trigger gap 212 in first direction, i.e., in the same first direction parallel to main electrode 206. Main electrode 206 extends away from main gap 210 in a direction perpendicular to that of main gap 210. And, trigger electrode 208 extends away from trigger gap 212 in a direction perpendicular to that of trigger gap 212.

This embodiment can be placed on a surface (as in FIG. 1B embodiment) or in a substrate (as in FIG. 1C).

Unlike the embodiments of FIGS. 1A-1C, end 209 of trigger electrode 208 is disposed in main gap 210. So, the length of trigger gap 212 is significantly less than the length of main gap 210. This placement allows plasma formed by a trigger pulse discharged by end 209 to be disposed directly in main gap 210.

Third Exemplary Switch Device

Figure 3:
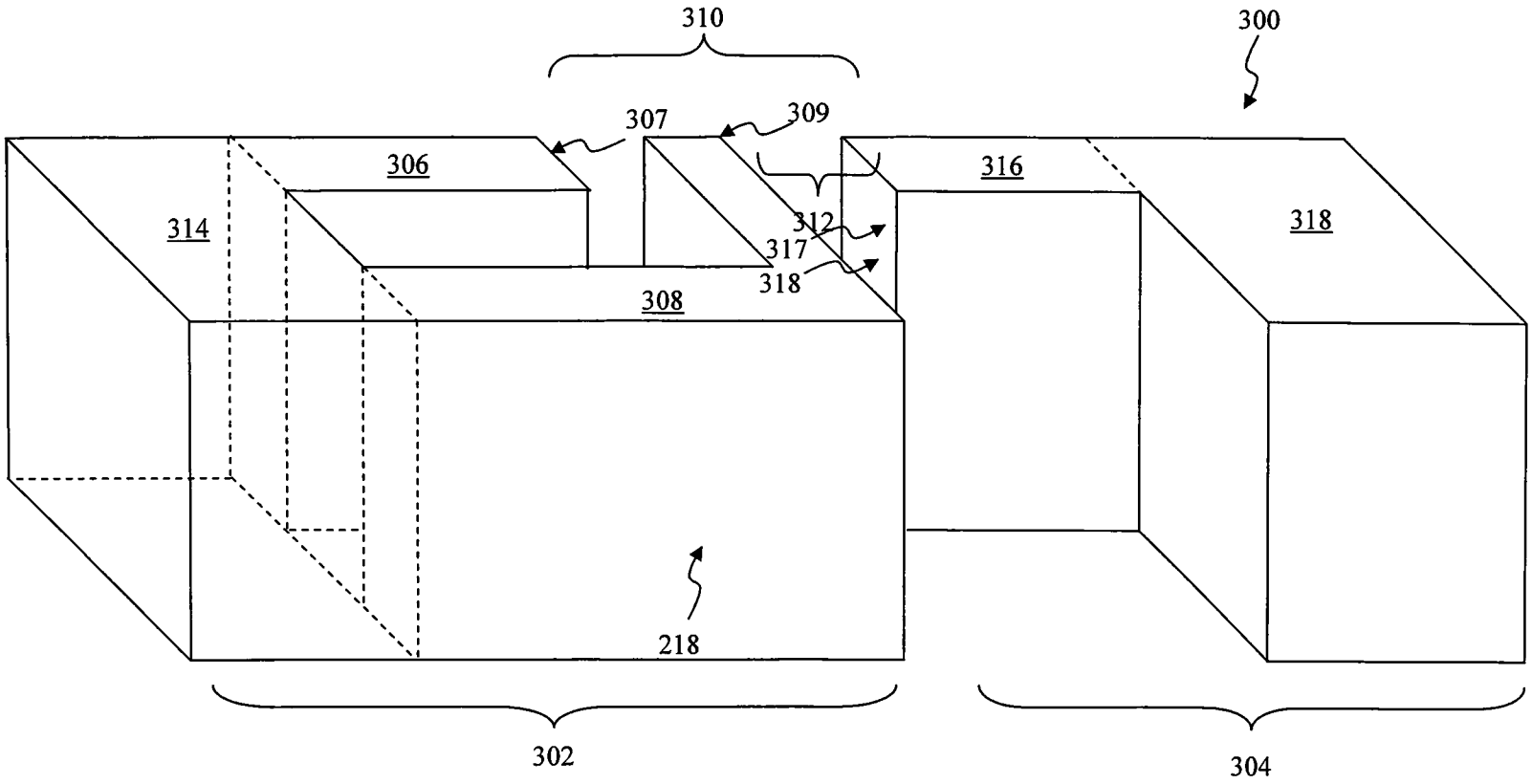
FIG. 3 shows an embodiment of a switch device having an electrode configuration different from that of FIG. 1A, FIG. 1B, FIG. 1C, and FIG. 2.

FIG. 3 shows an embodiment of a switch device. A switch device 300 includes an input electrode 302 and an output electrode 304. Input electrode 302 includes a main electrode 306 having an end 307, and a trigger electrode 308 having an end 309. Output electrode 304 includes a first part 317 and a second part 318. Main electrode 306 and trigger electrode 308 are electrically connected by a central electrode 314. A main gap 310 separates end 307 of main electrode 306 from first part 317 of output electrode 304. A trigger gap 312 separates end 309 of trigger electrode 308 from second part 318 of output electrode 304. First part 317 is the part of output electrode 304 that is closest to both main electrode 306 and trigger electrode 308.

Output electrode 304, main electrode 306 and trigger electrode 308 of switch device 300 are oriented differently than the corresponding parts of switch device 100. Unlike the embodiments of FIGS. 1A-1C, end 309 of trigger electrode 308 is disposed in main gap 310. So, the length of trigger gap 312 is significantly less than the length of main gap 310. This placement allows plasma formed by a trigger pulse discharged by end 309 to be disposed directly in main gap 310.

In the embodiment of FIG. 3, main electrode 306 extends from main gap 310 in a first direction. Trigger electrode 308 extends away from trigger gap 312 in a second direction perpendicular to the first direction. Main electrode 306 extends away from main gap 310 in a direction parallel to that of main gap 310. And, trigger electrode 308 extends away from trigger gap 312 in a direction perpendicular to that of trigger gap 312.

The switch devices described herein may be fabricated using any suitable process. By way of non-limiting example, photolithographic, chemical, machining, coating, and growing process steps may be used.

While various embodiments for different switch devices show specific locations and relative orientations for various gaps and electrodes, any suitable combination of locations and relative orientations may be used that allow the switch device to function as described herein. For example, various electrodes may be oriented relative to each other, and may extend away from their corresponding gaps in a variety of ways.

A switch device according to various embodiments may electrically connected to any suitable source of input signal. A switch device may be fabricated or disposed on or in a substrate to form an integrated circuit.

Exemplary Non-Linear Transmission Line

Any suitable non-linear transmission line may be used.

In some embodiments, the trigger electrode 108 is configured and arranged to operate as a non-linear transmission line that has a variable capacitance. Typically, the non-linear transmission line can be implemented using as nonlinear capacitors: metal-oxide materials known as varistors, np-junctions, or diodes made of silicon carbide (SiC), gallium-nitride (GaN), aluminum gallium-nitride (AlGaN) also known as varactors, or non-linear ceramic materials, but can include other materials, or combinations of materials, that will be apparent to those skilled in the relevant art(s) without departing from the spirit and scope of the present disclosure.

Figure 5:
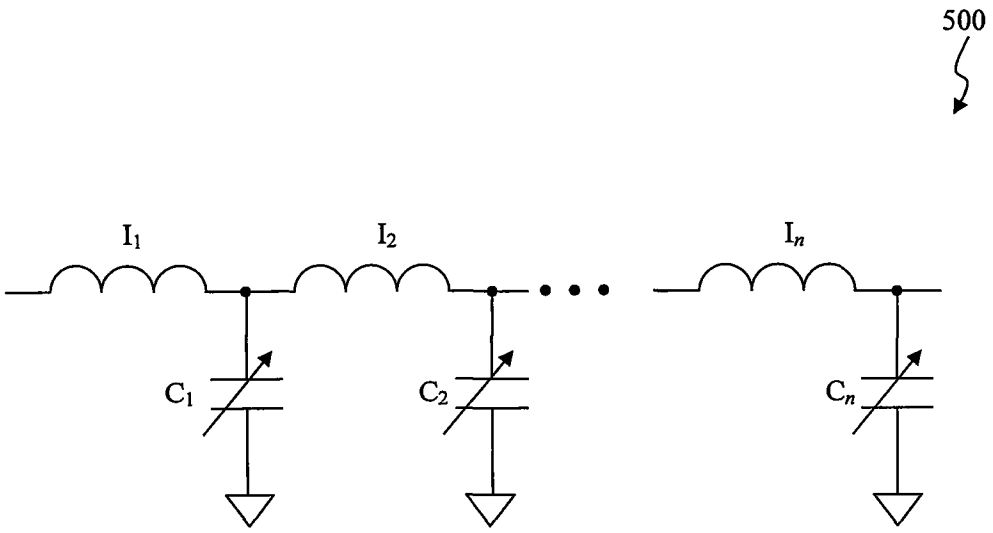
FIG. 5 shows an embodiment of a non-linear transmission line.

FIG. 5 illustrates a schematic diagram of an exemplary non-linear transmission line that can be implemented within any of the exemplary switch devices according to an exemplary embodiment of the present disclosure. As illustrated in FIG. 5, the non-linear transmission line 500 includes inductors $I_1$ through $I_n$ and capacitors $C_1$ through $C_n$. Each of the inductors $I_1$ through $I_n$ is coupled to a corresponding one of the capacitors $C_1$ through $C_n$.

In some embodiments, one or more of capacitors $C_1$ through $C_n$ can be implemented using variable capacitors, wherein the variable capacitors have capacitances that are a function of voltage on the variable capacitors. When multiple variable capacitors are connected in series, as voltage on the nonlinear transmission line increases, capacitance of the nonlinear transmission line can decrease.

In some embodiments, a variable capacitor can be included as a lumped element in the nonlinear transmission line. In an example, the variable capacitor can be formed by way of axially stacking such layers or radially stacking such layers. For instance, when the layers are radially stacked, the variable capacitor can include one or more concentric rings. The thicknesses of the one or more conductive layers are respectively selected such that the one or more conductive layers become conductive at particular voltages.

In some embodiments, the nonlinear transmission line can include a nanoparticle-modified complex dielectric material, wherein distribution of conductive nanoparticles in the complex dielectric material corresponds with a capacitance that alters as a function of voltage. The dielectric constant of the nanoparticle-modified complex dielectric material can be modified by leveraging the conductivity portion of a complex dielectric constant value, which becomes frequency dependent, thus introducing a strong nonlinear behavior (and thereby inducing pulse compression). Accordingly, a non-conductive material can be manufactured to have conductive nanoparticles distributed therein in accordance with a predefined distribution.

The capacitance of the nonlinear transmission line can be represented as a function of voltage on the nonlinear transmission line. In some embodiments, the capacitance (C) of the nonlinear transmission line can be represented as a function of voltage (C) on the nonlinear transmission line as denoted by:

$$C(V) = \frac{380\ \text{pF}}{(V+1)^{0.46}}, \tag{1}$$

Figure 4:
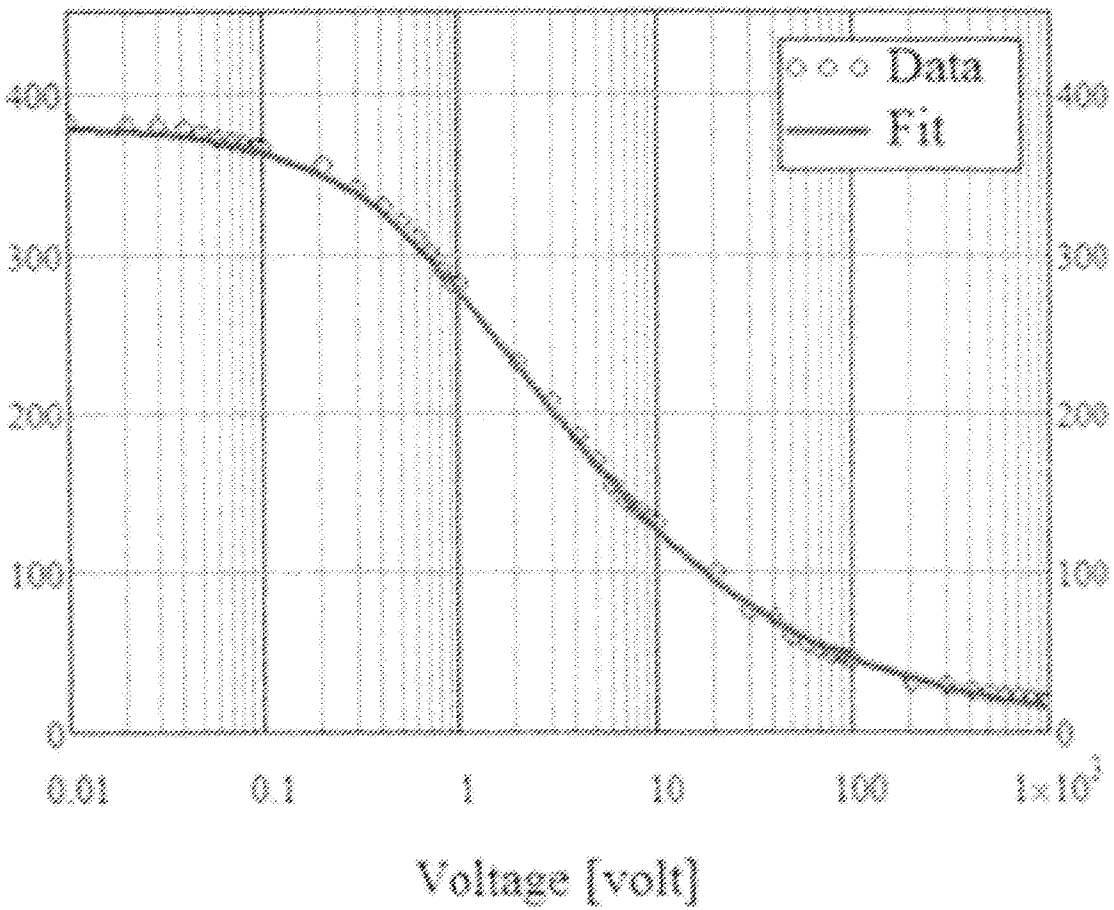
FIG. 4 shows a plot of capacitance as a function of voltage for a variable capacitor according to some embodiments.

As equation (1) illustrates, the capacitance of the non-linear transmission line decreases from a high value to a low value as the voltage of the non-linear transmission line is increased as graphically illustrated in FIG. 4. The non-linear transmission line is further described in U.S. patent application Ser. No. 14/010,157, filed Aug. 26, 2013, now U.S. Pat. No. 8,921,973, which is incorporated herein by reference in its entirety.

Method of Operation of the Exemplary Switch Devices

Figure 6:
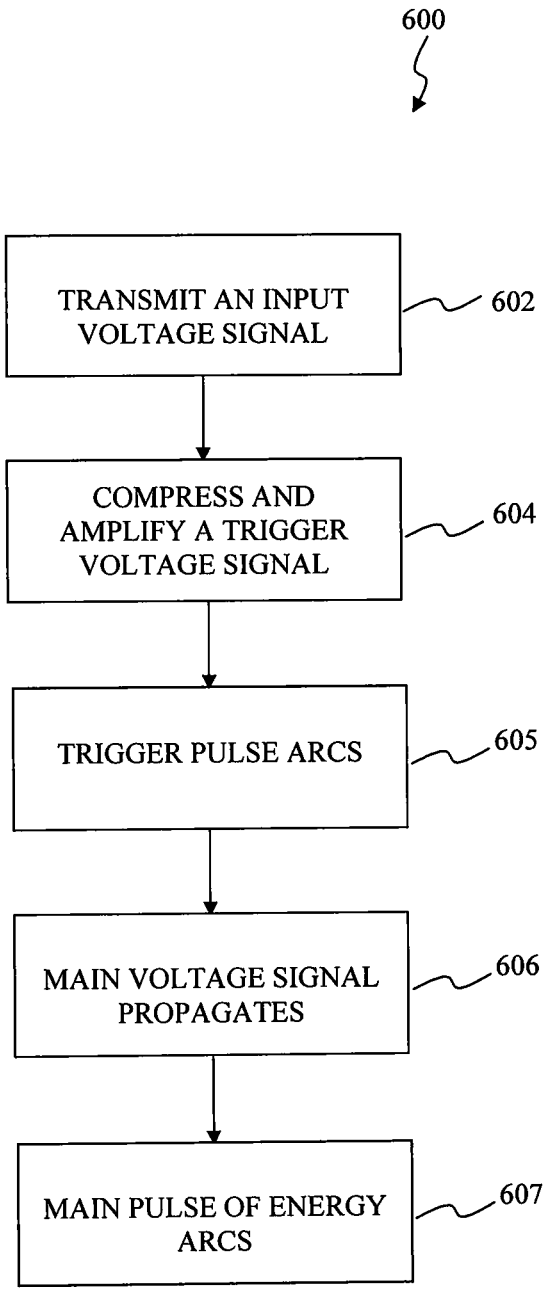
FIG. 6 shows an embodiment of a process flow for operating a switch.

FIG. 6 is a flowchart of exemplary operational for operating the exemplary switch devices. The following discussion describes an exemplary operational control flow 600 of a switch device, such as the switch device 100, the switch device 200, and/or the switch device 300 to provide some examples.

At step 602, the exemplary operational control flow 600 transmits an input voltage signal to an input electrode of the switch device. The input voltage signal creates a trigger voltage signal in a trigger electrode of the switch device, and a main voltage signal in a main electrode of the switch device. The input voltage signal can be a series of voltage pulses, or repetitive voltage pulses, ranging from a few Hertz (Hz) to many Megahertz (MHz) to provide an example.

At step 604, the exemplary operational control flow 600 compresses and amplifies the trigger voltage signal of step 602 in the trigger electrode to create a trigger pulse of energy.

At step 605, the trigger pulse arcs across the trigger gap, or between the trigger electrode and the main electrode. The amplification of the trigger voltage signal assists with such arcing, as arcing occurs at higher voltages. This arcing creates plasma in or near the main gap, such that a breakdown voltage of the main gap decreases. The specific location of arcing from the trigger electrode is not particularly important, so long as it creates plasma in or near the main gap. This plasma acts as a conductor, and decreases the breakdown voltage of the main gap.

In some embodiments, the trigger gap and/or the main gap include the solid material. In this exemplary embodiment, the trigger pulse of energy effectively vaporizes, namely changes a physical state from a solid to a gas, the solid material of the trigger gap and/or of the main gap when present by forming a plasma, or plasma-like material, in or near the main gap.

This vaporization of the solid material is irreversible. As a result, the switch device 100 can be considered to be a single operation device. However, if the main gap 110 and/or the trigger gap 112 does not include the solid material and is filled with the gas as discussed above, the switch device 100 can be considered to be a multi-operation or re-usable device.

When the trigger pulse of energy exceeds a breakdown voltage of any gas present within the trigger gap, a spark forms between the main electrode and the trigger electrode, ionizing the gas of the trigger gap. Usually, this ionizing of the gas of the trigger gap is violent and disruptive, often leading to sound, light, and/or heat.

At step 606, the main voltage signal propagates along the main electrode to the main gap. This creates a main pulse of energy at the end of the main electrode.

At step 607, the main pulse of energy arcs across the main gap to an output electrode of the switch device, while the breakdown voltage of the main gap is decreased by plasma created by the trigger pulse.

Depending on the structure of the switch, a solid material may be present in the main and/or trigger gap before the switch is used. The trigger pulse of energy and the main pulse of energy vaporizes any solid material that may be present in the main gap when present, and ionizes the gas of the main gap. Thereafter, an electric main current flows via arcing between the main electrode and the output electrode using a pathway formed by the ionized gas of the main gap to provide an output voltage signal.

The non-linear transmission line may amplify the trigger voltage signal by any suitable amount. In some embodiments, the trigger voltage signal is amplified by at least a factor of 3 in the trigger electrode.

The input signal may be a single pulse, or a repetitive pulse.

CONCLUSION

The Detailed Description referred to accompanying figures to illustrate exemplary embodiments consistent with the disclosure. References in the disclosure to "an exemplary embodiment" indicates that the exemplary embodiment described include a particular feature, structure, or characteristic, but every exemplary embodiment can not necessarily include the particular feature, structure, or characteristic. Moreover, such phrases are not necessarily referring to the same exemplary embodiment. Further, any feature, structure, or characteristic described in connection with an exemplary embodiment can be included, independently or in any combination, with features, structures, or characteristics of other exemplary embodiments whether or not explicitly described.

The exemplary embodiments described within the disclosure have been provided for illustrative purposes, and are not intend to be limiting. Other exemplary embodiments are possible, and modifications can be made to the exemplary embodiments while remaining within the spirit and scope of the disclosure. The disclosure has been described with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The Detailed Description of the exemplary embodiments fully revealed the general nature of the disclosure that others can, by applying knowledge of those skilled in relevant art(s), readily modify and/or adapt for various applications such exemplary embodiments, without undue experimentation, without departing from the spirit and scope of the disclosure. Therefore, such adaptations and modifications are intended to be within the meaning and plurality of equivalents of the exemplary embodiments based on the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

What is claimed is:

1. A device, comprising:

an input electrode comprising:

a main electrode, and a trigger electrode electrically connected to the main electrode, the trigger electrode comprising a non-linear transmission line; and an output electrode, wherein the output electrode is separated from an end of the main electrode by a main gap; and wherein the output electrode is separated from an end of the trigger electrode by a trigger gap, and wherein the trigger gap and main gap are located such that arcing of a current across the trigger gap or between the main electrode and the trigger electrode decreases a breakdown voltage of the main gap.

2. The device of claim 1, wherein a first part of the output electrode is separated from an end of the main electrode by the main gap, and the first part of the output electrode is separated from an end of the trigger electrode by the trigger gap.

3. The device of claim 1, wherein a first part of the output electrode is separated from an end of the main electrode by the main gap, and a second part of the output electrode is separated from an end of the trigger electrode by the trigger gap, wherein the first part of the output electrode and the second part of the output electrode are different.

4. The device of claim 1, wherein the end of the main electrode, the end of the trigger electrode are each disposed on the surface of a substrate, and wherein the main gap and the trigger gap are filled with a gas.

5. The device of claim 1, wherein at least one of the main electrode, the trigger electrode and the output electrode is partially exposed, and the main gap and trigger gap are through the substrate.

6. The device of claim 5, wherein one of the end of the trigger electrode and the end of the main electrode are disposed on a surface of the substrate.

7. The device of claim 3, wherein the length of the main gap is not more than ten percent different than the length of the trigger gap, and wherein the trigger electrode is not disposed in the main gap.

8. The device of claim 7, wherein the main electrode extends away from the main gap in a first direction, and wherein the trigger electrode extends away from the trigger gap in the first direction parallel to the main electrode.

9. The device of claim 2, wherein the end of the trigger electrode is disposed in the main gap.

10. The device of claim 9, wherein the main electrode extends from the main gap in a first direction, and wherein the trigger electrode extends away from the trigger gap in the first direction parallel to the main electrode.

11. The device of claim 9, wherein the main electrode extends from the main gap in a first direction, and wherein the trigger electrode extends from the trigger gap in a second direction that is perpendicular to the first direction.

12. The device of claim 1, wherein the non-linear transmission line comprises:

a plurality of inductors; and a plurality of capacitors, each capacitor from among the plurality of capacitors being coupled to a corresponding inductor from among the plurality of inductors.

13. The device of claim 1, wherein the main gap has a length of 2 microns to 1000 microns.

14. A device, comprising:

an input electrode comprising:

a main electrode, and a trigger electrode electrically connected to the main electrode, the trigger electrode comprising a non-linear transmission line; and an output electrode, the output electrode being separated from the main electrode and the trigger electrode by a main gap and a trigger gap, respectively, wherein the non-linear transmission line is configured to compress and to amplify a trigger voltage signal to cause the trigger electrode to emit a trigger pulse of energy, that creates plasma in or near the main gap, such that a breakdown voltage of the main gap decreases, wherein the main electrode is configured to propagate a main voltage signal to cause the main electrode to emit a main pulse of energy, that creates, assisted by the plasma created by the trigger pulse of energy, an arc from the main gap to the output electrode.

15. A method for operating a switch device, the switch device comprising:

an input electrode comprising:

a main electrode, and a trigger electrode electrically connected to the main electrode, the trigger electrode comprising a non-linear transmission line; and an output electrode, wherein a first part of the output electrode is separated from an end of the main electrode by a main gap; and the a second part of the output electrode is separated from an end of the trigger electrode by a trigger gap, the method comprising:

transmitting an input voltage signal to the input electrode, wherein the input voltage signal creates a trigger voltage signal in the trigger electrode, and a main voltage signal in the main electrode;

compressing and amplifying the trigger voltage signal in the trigger electrode, to create a trigger pulse of energy that creates plasma in or near the main gap, such that a breakdown voltage of the main gap decreases; and propagating the main voltage signal along the main electrode to the main gap, to create a main pulse of energy that arcs across the main gap to the output electrode while the breakdown voltage of the main gap is decreased.

16. The process of claim 15, wherein, prior to transmitting the input voltage signal, a solid material is present in the main gap and the trigger gap, and wherein the trigger pulse and the main pulse vaporize the solid material.

17. The process of claim 15, wherein, prior to transmitting the input voltage signal, a gas is present in the main gap and the trigger gap.

18. The process of claim 15, wherein the trigger voltage is amplified by a factor of at least 3 in the trigger electrode.

19. The process of claim 15, wherein the input voltage signal is a single pulse.

20. The process of claim 15, wherein the input voltage signal is a repetitive pulse.

* * * * *